US008406679B2

(12) United States Patent
Nakasone

(10) Patent No.: US 8,406,679 B2
(45) Date of Patent: Mar. 26, 2013

(54) IMAGE FORMING UNIT AND IMAGE FORMING APPARATUS

(75) Inventor: Yasushi Nakasone, Tokyo (JP)

(73) Assignee: Oki Data Corporation, Tokyo (JP)

( * ) Notice: Subject to any disclaimer, the term of this patent is extended or adjusted under 35 U.S.C. 154(b) by 382 days.

(21) Appl. No.: 12/801,674

(22) Filed: Jun. 21, 2010

(65) Prior Publication Data

US 2010/0322687 A1 Dec. 23, 2010

(30) Foreign Application Priority Data

Jun. 22, 2009 (JP) ..... 2009-148017

(51) Int. Cl.
*G03G 21/10* (2006.01)

(52) U.S. Cl. ..... 399/358; 399/359

(58) Field of Classification Search ..... 399/358, 399/359

See application file for complete search history.

(56) References Cited

U.S. PATENT DOCUMENTS

| | | | | |
|---|---|---|---|---|
| 5,956,556 | A | 9/1999 | Nakajima et al. | 399/359 |
| RE38,978 | E * | 2/2006 | Nakajima et al. | 399/359 |
| 2009/0110456 | A1 * | 4/2009 | Fujii | 399/358 |

FOREIGN PATENT DOCUMENTS

| | | |
|---|---|---|
| JP | 4-50871 U | 4/1992 |
| JP | 9-218627 | 8/1997 |
| JP | 11-073078 A | 3/1999 |
| JP | 2007-93640 | 4/2007 |

OTHER PUBLICATIONS

Machine translation of JP 09-218627 dated Sep. 1, 2012.*
Machine translation of JP 2007-093640 dated Sep. 1, 2012.*

* cited by examiner

*Primary Examiner* — Sophia S Chen
(74) *Attorney, Agent, or Firm* — Rabin & Berdo, P.C.

(57) ABSTRACT

An image forming unit includes a developer collecting portion for collecting a developer, a developer conveying portion having a receiving portion and an exit portion. The image forming unit further includes a developer conveying unit that conveys the developer from the receiving portion to the exit portion. The developer conveying portion has a guide portion for guiding the developer conveying unit. One of the guide portion and the developer conveying portion has a contact portion that causes the guide portion and the developer conveying portion to partially contact each other in such a manner that a gap is partially formed therebetween.

30 Claims, 11 Drawing Sheets

IMAGE FORMING UNIT AND IMAGE FORMING APPARATUS

BACKGROUND OF THE INVENTION

The present invention relates to an image forming unit and an image forming apparatus.

Generally, an image forming apparatus such as a printer, a copier, a facsimile machine, a complex machine or the like includes process cartridges (i.e., image forming units) of black, yellow, magenta and cyan. Further, LED heads, transfer rollers and the like are provided so as to face the respective process cartridges. Each process cartridge includes a photosensitive drum, a charging roller, a developing unit, a cleaning blade and the like. The developing unit includes a developing roller, a toner supplying roller, a developing blade and the like. Components of the process cartridge are housed in a cartridge main body, and a toner cartridge is detachably mounted onto the cartridge main body.

The charging roller uniformly charges the surface of the photosensitive drum, and then the LED unit irradiates the surface of the photosensitive drum to form a latent image. The developing roller holds a toner (i.e., a developer) thereon, and causes the toner to adhere to the latent image on the surface of the photosensitive drum, so as to form a toner image. The transfer roller transfers the toner image from the photosensitive drum to a sheet. By transferring the toner images of the respective photosensitive drums of the image forming units to the sheet, a color toner image is transferred to the sheet. Then, a fixing unit fixes the color toner image to the sheet, so that a color image is formed on the sheet.

The toner remaining on the photosensitive drum after the transferring of the toner image is removed therefrom by the cleaning blade, and such a waste toner is collected in a waste toner chamber provided in the toner cartridge.

A configuration for conveying the waste toner to the waste toner chamber of the toner cartridge is as follows. A groove is formed on a side frame of each process cartridge. The groove extends in the form of a loop along the side frame. Further, a toner conveying belt is provided in the groove. The toner conveying belt has a plurality of teeth on an outer circumferential surface. The toner conveying belt moves to convey the waste toner (collected from the cleaning blade) to the waste toner chamber (see, Japanese Laid-open Patent Publication No. H11-73078).

Recently, there is a demand for a technology capable of reducing a noise.

SUMMARY OF THE INVENTION

The present invention is intended to provide an image forming unit and an image forming apparatus capable of reducing a noise.

The present invention provides an image forming unit including a developer collecting portion for collecting a developer, a developer conveying portion having a receiving portion and an exit portion. The image forming unit further includes a developer conveying unit that conveys the developer from the receiving portion to the exit portion. The developer conveying portion has a guide portion for guiding the developer conveying unit. One of the guide portion and the developer conveying unit has a contact portion that causes the guide portion and the developer conveying unit to partially contact each other in such a manner that a gap is partially formed therebetween.

With such a configuration, a contacting area between the guide portion and the developer conveying unit is reduced.

Therefore, it becomes possible to obtain an image forming unit and an image forming apparatus capable of reducing a noise.

The present invention also provides an image forming apparatus including a developer collecting portion for collecting a developer, a developer conveying portion having a receiving portion and an exit portion. The image forming unit further includes a developer conveying unit that conveys the developer from the receiving portion to the exit portion. The developer conveying portion has a guide portion for guiding the developer conveying unit. One of the guide portion and the developer conveying unit has a contact portion that causes the guide portion and the developer conveying unit to partially contact each other in such a manner that a gap is partially formed therebetween.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to drawings. A color printer will be described as an example of an image forming apparatus that performs printing (i.e., forms an image).

First Embodiment.

Figure 1:
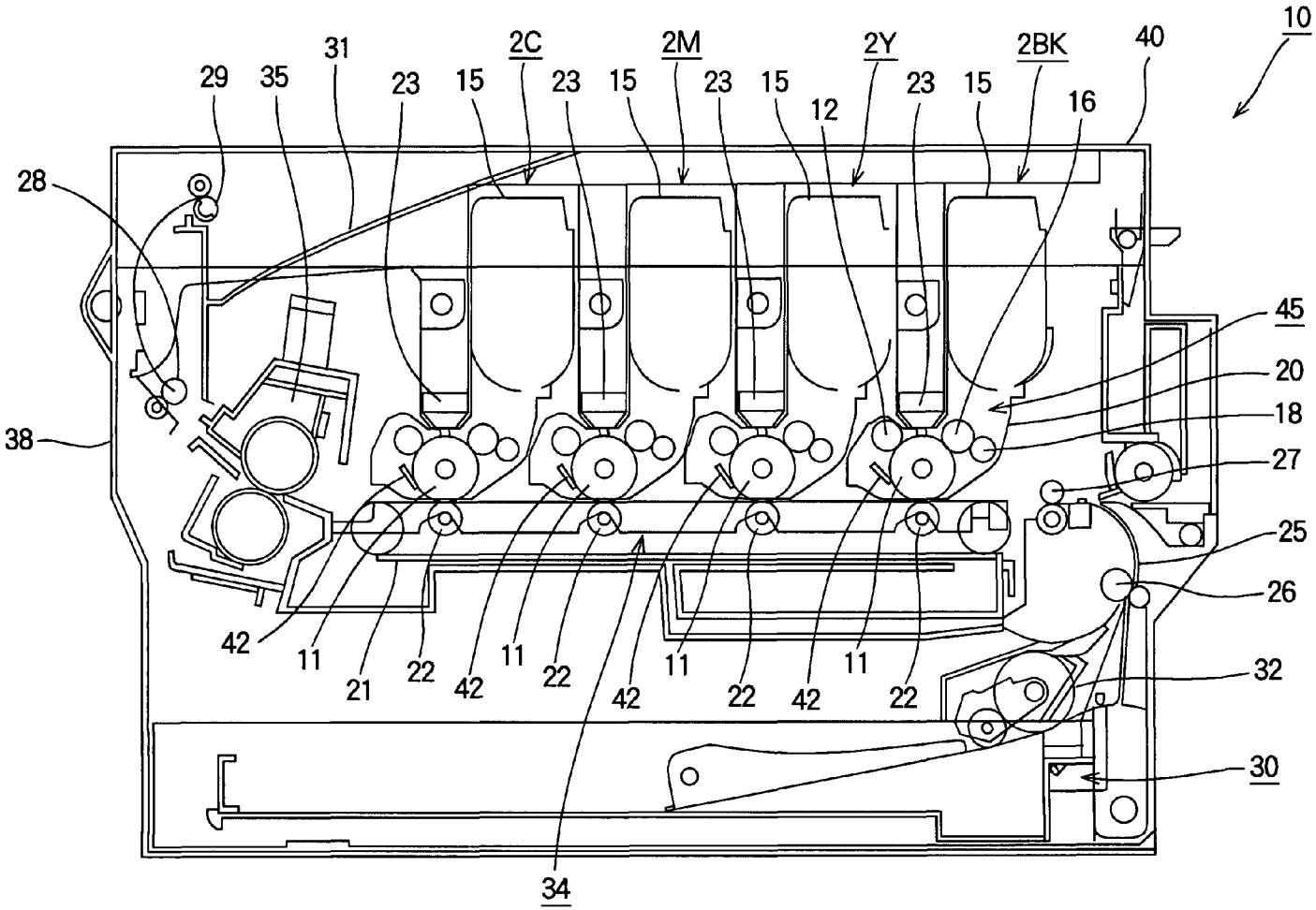
FIG. 1 is a schematic view showing a configuration of a printer according to the first embodiment of the present invention.

FIG. 1 is a schematic side view of a printer as an image forming apparatus according to the first embodiment of the present invention.

In FIG. 1, the printer includes an apparatus main body 10 (i.e., a main body of the printer). A feeding path 25 is provided in the apparatus main body 10, along which a not shown sheet (i.e., a medium) is fed. Feeding rollers 26, 27, 28 and 29 are provided for feeding the sheet along the feeding path 25 in the apparatus main body 10. Further, process cartridges 2Bk, 2Y, 2M and 2C (i.e., image forming units) are provided along the feeding path for forming toner images (i.e., developer images) of black, yellow, magenta and cyan. A transfer unit 34 is provided below and facing the respective process cartridges 2Bk, 2Y, 2M and 2C. The transfer unit 34 feeds the sheet, and transfers the toner images of the respective colors to the sheet. The above described feeding path 25 extends between the transfer unit 34 and the process cartridges 2Bk, 2Y, 2M and 2C.

In the apparatus main body 10, LED (Light Emitting Diode) units 23 as exposure devices (or recording heads) are provided so as to face photosensitive drums 11 (i.e., image bearing bodies) of the respective process cartridges 2Bk, 2Y, 2M and 2C. A fixing unit 35 is provided on a downstream side of the transfer unit 34. The fixing unit is configured to fix a toner image (having been transferred thereto by the transfer unit 34) to the sheet.

In each of the process cartridges 2Bk, 2Y, 2M and 2C (collectively referred to as a process cartridge 2), the photosensitive drum 11 (i.e., an image bearing body) is driven by a not shown drum motor (i.e., a driving portion) to rotate at a predetermined rotational speed. The photosensitive drum 11 is able to hold electric charge at a surface thereof. The electric charge on the surface of the photosensitive drum 11 is dissipated when irradiated by the LED head 23, so that a latent image is formed on the surface of the photosensitive drum 11. A charging roller 12 (i.e., a charging device) is pressed against the surface of the photosensitive drum 11 at a constant pressure. The charging roller 12 rotates in a rotational direction opposite to the photosensitive drum 11, and applies a predetermined voltage to the photosensitive drum 11.

A developing unit 45 is provided adjacent to the photosensitive drum 11. The developing unit 45 is configured to develop the latent image on the surface of the photosensitive drum 11 to form a toner image (i.e., a developer image). The developing unit 45 includes a developing roller 16 (i.e., a developer bearing body) that causes the toner to adhere to the surface of the photosensitive drum 11, a not shown developing blade (i.e., a developer layer regulating member) that regulates a thickness of a toner layer (i.e., a developer layer) on the surface of the developing roller 16, a toner supplying roller 18 (i.e., a developer supplying member) that supplies the toner to the developing roller 16, and the like. The developing roller 16 is pressed against the photosensitive drum 11 at a constant pressure, and rotates in a rotational direction opposite to the photosensitive drum 11. The toner supplying roller 18 is pressed against the developing roller 16 at a constant pressure, and rotates in the same rotational direction as the developing roller 16.

A cleaning blade 42 (i.e., a cleaning member) is provided along the photosensitive drum 11 in such a manner that an edge of the cleaning blade 42 contacts the surface of the photosensitive drum 11. In this regard, the cleaning blade 42 constitutes a developer collecting unit.

The photosensitive drum 11, the charging roller 12, the developing unit 45 and the like are housed in a housing 20 which constitutes a main body of the process cartridge 2. A toner cartridge 15 as a developer cartridge (i.e., a developer storing portion) for storing the toner is detachable mounted onto the housing 20.

The transfer unit 34 includes a transfer belt 21 and transfer rollers (i.e., transfer members) 22 provided so as to face respective photosensitive drums 11 of the process cartridges 2Bk, 2Y, 2M and 2C. The transfer belt and the transfer rollers 22 are applied with predetermined voltages by a not shown voltage application unit, so as to transfer the toner images of the respective colors from the photosensitive drums 11 to the sheet.

The apparatus main body 10 includes a lower frame 38 and an upper frame 40 swingably provided on the lower frame 38. The upper frame 40 has a stacker 31 for placing the sheets ejected out of the apparatus main body 10. A sheet cassette 30 (i.e., a medium storing portion) is provided below the transfer unit 34. The sheet cassette 30 is defines an end of the feeding path 25, and stores a stack of the sheets. A delivery portion 32 is provided above and adjacent to the sheet cassette 30, which delivers the individual sheets from the sheet cassette 30 into the feeding path 25.

Next, an operation of the above configured printer will be described.

When a power of the printer is turned on, a controller (not shown) of the printer performs an initial operation so as to place the printer in a standby mode. Then, when the printer receives a print command from a superior device such as a host computer (not shown), the delivery portion 32 delivers the individual sheet from the sheet cassette 30 into the feeding path 25. Then, the feeding rollers 26 and 27 feed the sheet to the transfer belt 21 of the transfer unit 34. The transfer belt 21 moves (circulates) so as to feed the sheet through between the transfer unit 34 and the process cartridges 2Bk, 2Y, 2M and 2C.

In each of the process cartridges 2Bk, 2Y, 2M and 2C, the charging roller 12 uniformly charges the surface of the photosensitive drum 11, and the LED head 23 exposes the surface of the photosensitive drum 11 to form a latent image thereon. Then, the developing unit 45 develops the latent image to form the photosensitive drum 11 to form a toner image of the respective color.

While the sheet is being fed by the transfer belt 21 along the process cartridges 2Bk, 2Y, 2M and 2C, the toner images of the respective colors are transferred from the photosensitive drums 11 to the sheet, so that a color toner image is transferred to the sheet. The sheet is then fed to the fixing unit 35, where the color toner image is fixed to the sheet. Then, the sheet is ejected out of the apparatus main body 10 by the feeding rollers 28 and 29, and is placed on the stacker 31.

In this regard, the toner remaining on the photosensitive drum 11 on each process cartridge 2 is scraped off and removed by the cleaning blade 42. The toner having been removed by the cleaning blade 42 is referred to as a waste toner. The waste toner (i.e., a waste developer) is collected into a waste toner chamber (i.e., a waste developer chamber) formed in the toner cartridge 15.

Next, a description will be made of an apparatus for conveying the waste toner (having been removed by the cleaning blade 42 in the process cartridge 2) to the waste toner chamber. The process cartridges 2Bk, 2Y, 2M and 2C have the common configurations except the toner, and are collectively referred to as the process cartridge 2.

Figure 2:
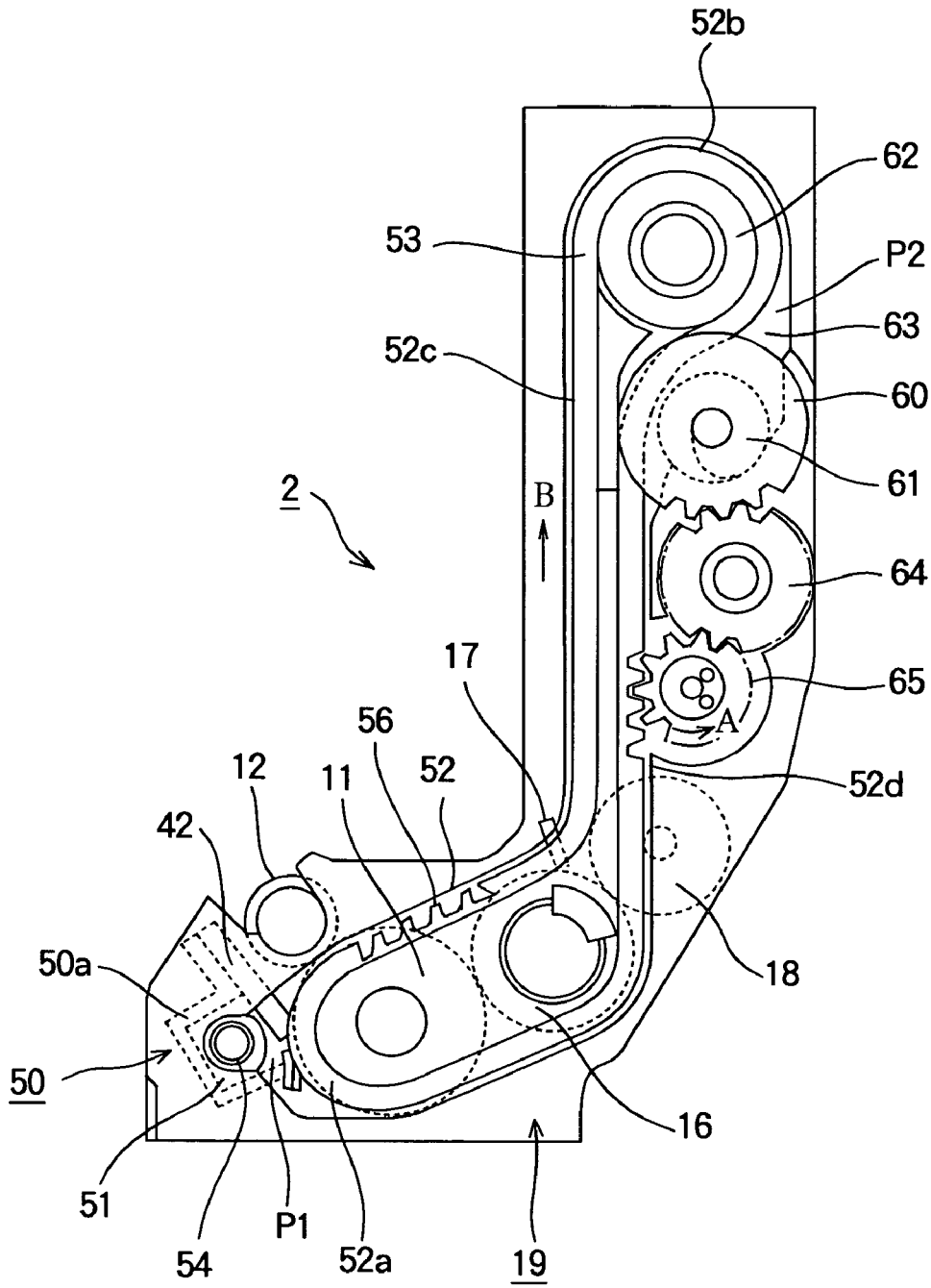
FIG. 2 is a schematic view showing an internal configuration of a process cartridge according to the first embodiment of the present invention.
Figure 3:
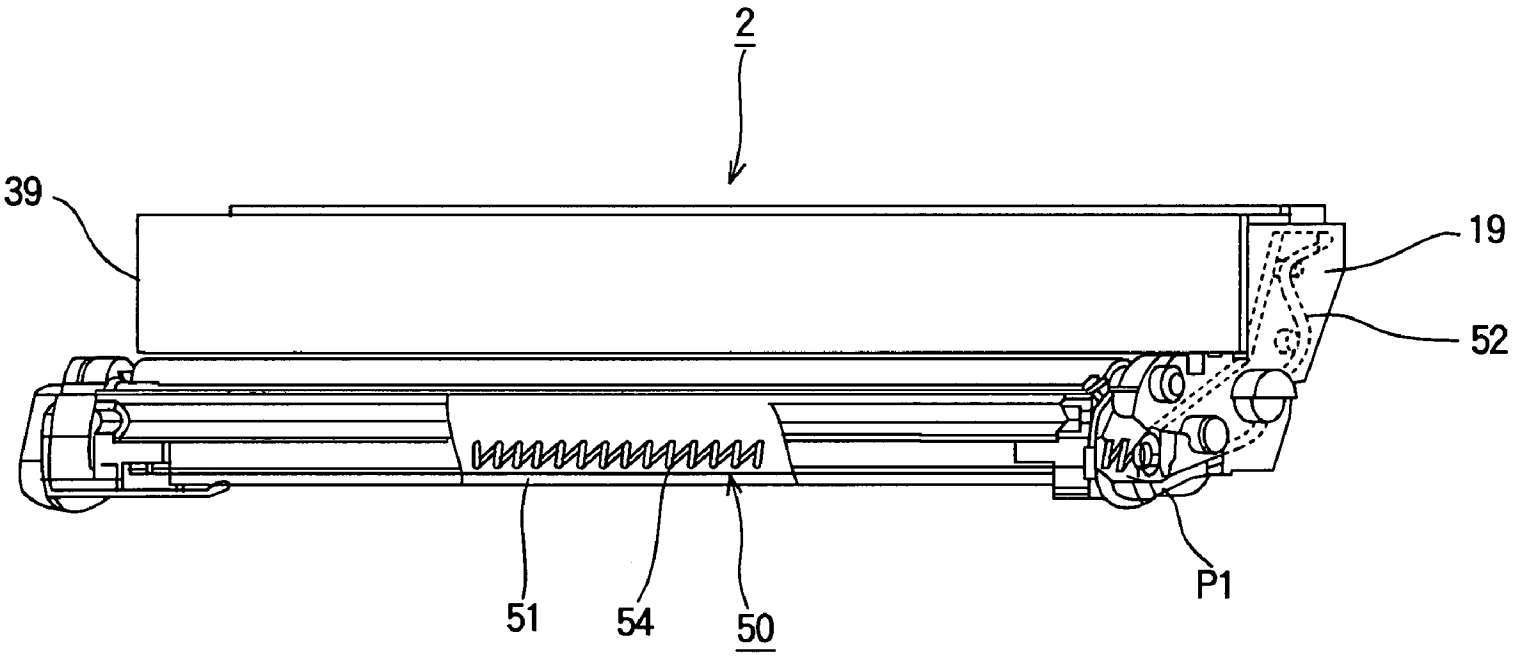
FIG. 3 is a perspective view showing the process cartridge according to the first embodiment of the present invention.
Figure 4:
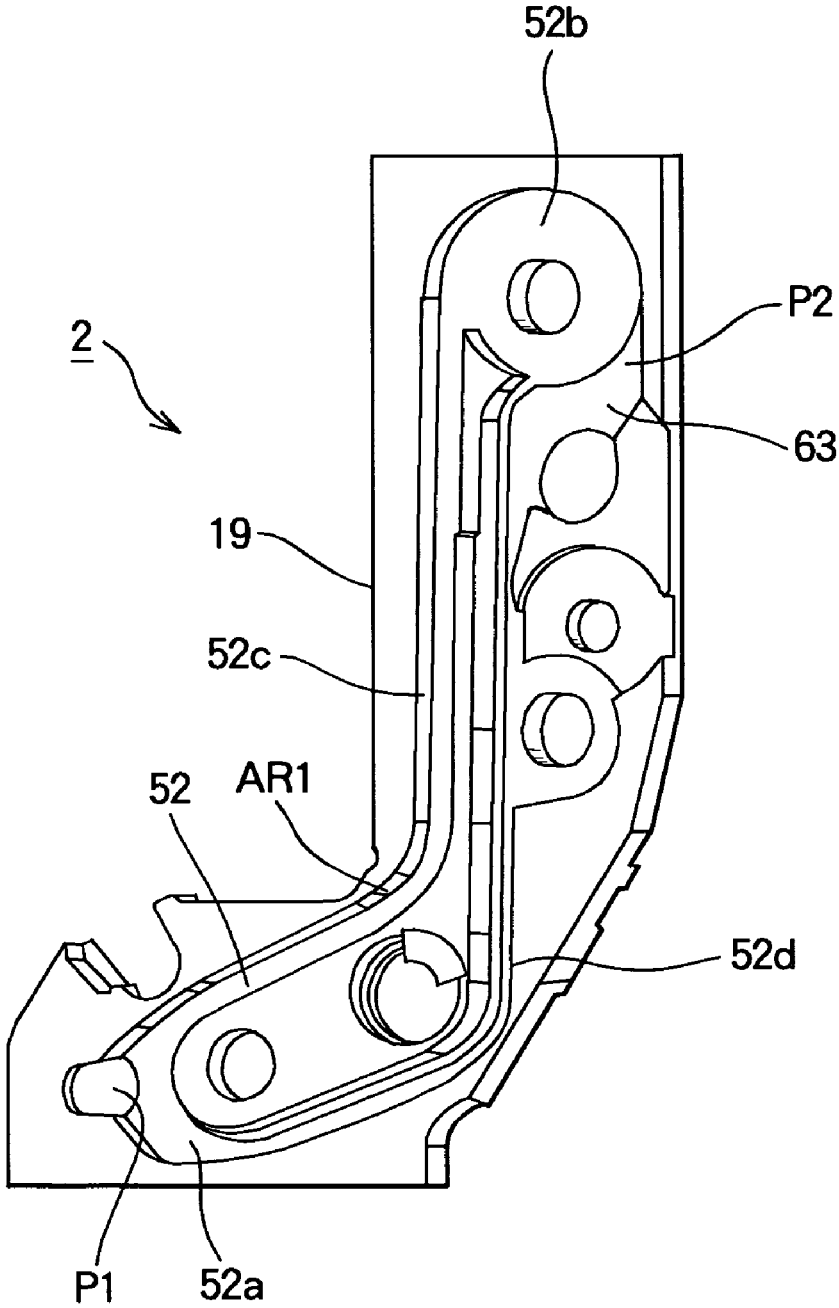
FIG. 4 is a perspective view showing a groove formed on a side frame according to the first embodiment of the present invention.
Figure 5:
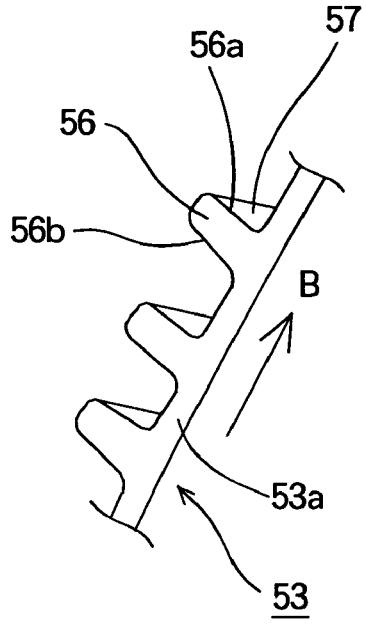
FIG. 5 is an enlarged view showing a part of a toner conveying belt according to the first embodiment of the present invention.

FIG. 2 is a sectional view showing the internal configuration of the process cartridge 2 according to the first embodiment of the present invention. FIG. 3 is a perspective view showing the process cartridge 2 according to the first embodiment of the present invention. FIG. 4 is a perspective view showing a side frame of the process cartridge 2 according to the first embodiment of the present invention. FIG. 4 is an enlarged view showing a part of a toner conveying belt according to the first embodiment of the present invention. FIG. 5 is another enlarged view showing a part of the toner conveying belt according to the first embodiment of the present invention.

As shown in FIG. 2, the process cartridge 2 includes the photosensitive drum 11, the charging roller 12, the developing roller 16, the developing blade 17, and the toner supplying roller 18 as described above. As shown in FIG. 3, side frames 19 and 39 are provided on both sides of the process cartridge 2. The side frames 19 and 39 constitute both lateral walls of the process cartridge 2. The process cartridge 2 further includes a cleaning apparatus 50 disposed so as to extend between the side frames 19 and 39.

As shown in FIG. 2, the cleaning apparatus 50 includes a case 50*a* extending along the photosensitive drum 11 and having an open side facing the photosensitive drum 11. The case 50*a* has a waste toner storing portion (i.e., a waste developer storing portion). The cleaning apparatus 50 further includes the cleaning blade 42 fixed to the case 50*a*, and a collection spiral 54 (i.e., a conveying unit or a conveying member) rotatably provided in the waste toner storing portion 51. The collection spiral 54 is linked to the above described drum motor, and is rotated by the drum motor. Here, the drum motor is used as the driving portion in this embodiment, but it is also possible to use other motor.

The waste toner is removed from the photosensitive drum 11 by the cleaning blade 42, falls in the case 50*a*, and is collected at the waste toner storing portion 51.

As the collection spiral 54 rotates, the collection spiral conveys the waste toner in the waste toner storing portion 51 toward the side frame 19.

The side frame 19 has a groove 52 (i.e., a guide portion) extending in the form of a loop (see, FIG. 4). As shown in FIG. 4, the groove 52 includes a U-shaped portion 52*a* formed in the vicinity of the lower end of the side frame 19, and another U-shaped portion 52*b* formed in the vicinity of the upper end of the side frame 19. Further, the groove 52 includes two connecting portions 52*c* and 52*d* extending between the lower and upper U-shaped portions 52*a* and 52*b*. The side frame 19 constitutes a developer conveying portion.

As shown in FIG. 2, a toner conveying belt 53 as a developer conveying belt (i.e., a developer conveying unit) is provided in the groove 52. The toner conveying belt 53 is in the form of an endless belt, and has a length slightly longer than an inner circumferential length of the groove 52. A belt driving gear 65 is provided for driving the toner conveying belt 53 to move. When the belt driving gear 65 (i.e., a belt driving element) is driven by the above described drum motor (not shown) to rotate in a direction shown by an arrow A, the toner conveying belt 53 moves along the groove 52 in a direction shown by an arrow B. The toner conveying belt 53 is guided by the groove 52. A pulley 62 is provided in the U-shaped portion 52*b* of the groove 52. The pulley 62 contacts an inner circumference of the toner conveying belt 53, and assists the toner conveying belt 53 moving smoothly.

The belt driving gear 65 is linked to the drum motor via not shown idle gears and a not shown driving gear provided on the photosensitive drum 11.

The groove 52 is connected to the waste toner storing portion 51 at a receiving portion P1 defined at a lower end of the side frame 19. The toner conveying belt faces the waste toner storing portion 51 via the receiving portion P1. The toner conveying belt 53 includes a belt main body 53*a* and a plurality of teeth 56 (convex portions) protruding from the outer circumference of the belt main body 53*a*. The above described belt driving gear 65 meshes with the teeth 56. When the toner conveying belt 53 is moved by the belt driving gear 65, the toner conveying belt 53 receives the waste toner from the waste toner storing portion 51 via the receiving portion P1, and conveys the waste toner in the direction indicated by the arrow B.

In this regard, in FIG. 3, the center part of the process cartridge 2 and the lower part of the side frame are shown partially cutaway to illustrate that the collection spiral 54 leads to the receiving portion P1.

The groove 52 is connected to a toner recovery portion 63 (i.e., a developer recovery portion) at an exit portion P2 defined at the upper part of the side frame 19. The toner conveying belt 53 faces the toner recovery portion 63 via the exit portion P2. The waste toner having been conveyed by the toner conveying belt 53 (in the direction indicated by the arrow B) to the exit portion P2 falls into the toner recovery portion 63, and is collected at the toner recovery portion 63.

The toner recovery portion 63 is connected to the above described waste toner chamber (not shown) of the toner cartridge 15, and therefore the waste toner is ejected to the waste toner chamber of the toner cartridge 15. For this purpose, the belt driving gear 65 engages an idle gear 64, and the idle gear 64 engages a conveying gear 60 (i.e., a conveying element). The conveying gear 60 is provided with a spiral shaft 61 (i.e., an ejecting element). The spiral shaft 61 is disposed so as to protrude into the waste toner chamber of the toner cartridge 15. As the spiral shaft 61 rotates, the spiral shaft 61 conveys the waste toner in the axial direction thereof.

Therefore, when the rotation of the belt driving gear 65 is transmitted to the spiral shaft 61 and the spiral shaft 61 rotates, the waste toner collected in the toner recovery portion 63 is ejected to the waste toner chamber of the toner cartridge 15.

Figure 6:
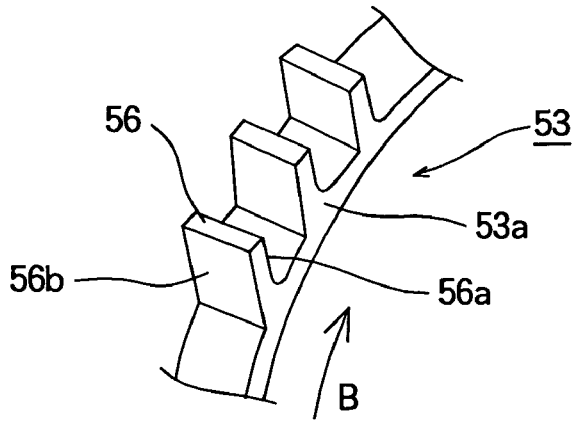
FIG. 6 is another enlarged view showing a part of the toner conveying belt according to the first embodiment of the present invention.

As shown in FIGS. 5 and 6, each tooth 56 of the toner conveying belt 53 is formed so as to be inclined toward a forward direction along the moving direction (indicated by the arrow B) of the toner conveying belt 53. In other words, tip of the tooth 56 is shifted forward in the moving direction of the toner conveying belt 53, compared with a root of the tooth 56. Each tooth 56 has a front surface 56*a* of a reverse involute form and a rear surface 56*b* of an involute form. The front surface 56 of the tooth 56 forms a cavity 57 in which the waste toner can be stored. With such a cavity 57, the tooth 56 is able to receive the waste toner at the receiving portion P1 of the side frame 19. As a result, the toner conveying belt 53 is able to receive and convey a large amount of the waste toner.

Further, since the rear surface 56*b* of each tooth 56 has involute form, the tooth 56 can smoothly mesh with the belt driving gear 65. Therefore, it becomes possible to reduce the load on the drum motor for rotating the belt driving gear 65 to move the toner conveying belt 53. Further, a noise generated by meshing of the belt driving gear 65 and the teeth 56 of the toner conveying belt 53 can be suppressed.

In this regard, shafts of the rotating bodies such as the photosensitive drum 11, the charging roller 12, the developing roller 16, the toner supplying roller 18 and the like are rotatably supported by the side frames 19 and 39. Further, shafts of the pulley 62 and shafts of the gears such as belt driving gears 65, the idle gear 64, the conveying gear 60 are rotatably supported by the side frame 19.

In this embodiment, the groove 52 extends so as to avoid the respective shafts supported by the side frame 19. To be more specific, the U-shaped portion 52*a* extends so as to surround the shaft of the photosensitive drum 11, and the U-shaped portion 52*b* extends so as to surround the shaft of the pulley 62. The connecting portions 52*c* and 52*d* extend on both sides of the shaft of the developing roller 16 so as to avoid the shafts of the toner supplying roller 18, the belt driving gear 65, the idle gear 64 and the conveying gear 60.

Sections of the connecting portions 52*c* and 52*d* adjacent to the shafts of the toner supplying roller 18, the belt driving gear 65, the idle gear 64 and the conveying gear 60 extend vertically. In contrast, sections of the connecting portions 52*c* and 52*d* on both sides of the developing roller 16 extend obliquely.

Since the groove 52 is formed so as to avoid the respective shafts as described above, the groove 52 has a complicated shape, and has a plurality of curved sections. Therefore, the toner conveying belt 53 is also curved along the curved sections of the groove 52. Where the toner conveying belt 53 is curved, a friction between the toner conveying belt 53 and the side wall of the groove 52 may occur. Particularly, if such a friction may cause a vibration of the toner conveying belt 53 at high frequency, a noise may be generated. Further, if the waste toner is molten by the friction and is fixed to the tips of the teeth 56, the load on the drum motor for moving the toner conveying belt 53 may increase.

Therefore, the first embodiment of the present invention is intended to reduce a friction between the tooth 56 of the toner conveying belt 53 and the side wall of the groove 52.

Figure 7:
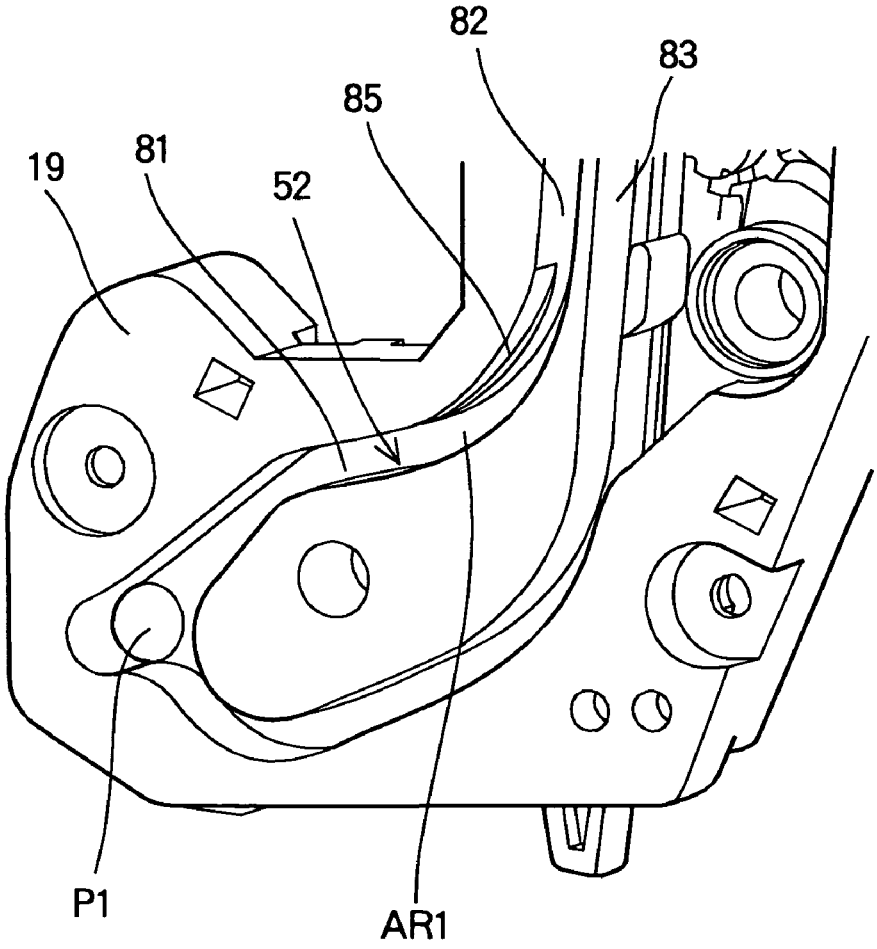
FIG. 7 is a perspective view showing a main part of the side frame of the printer according to the first embodiment of the present invention.
Figure 8:
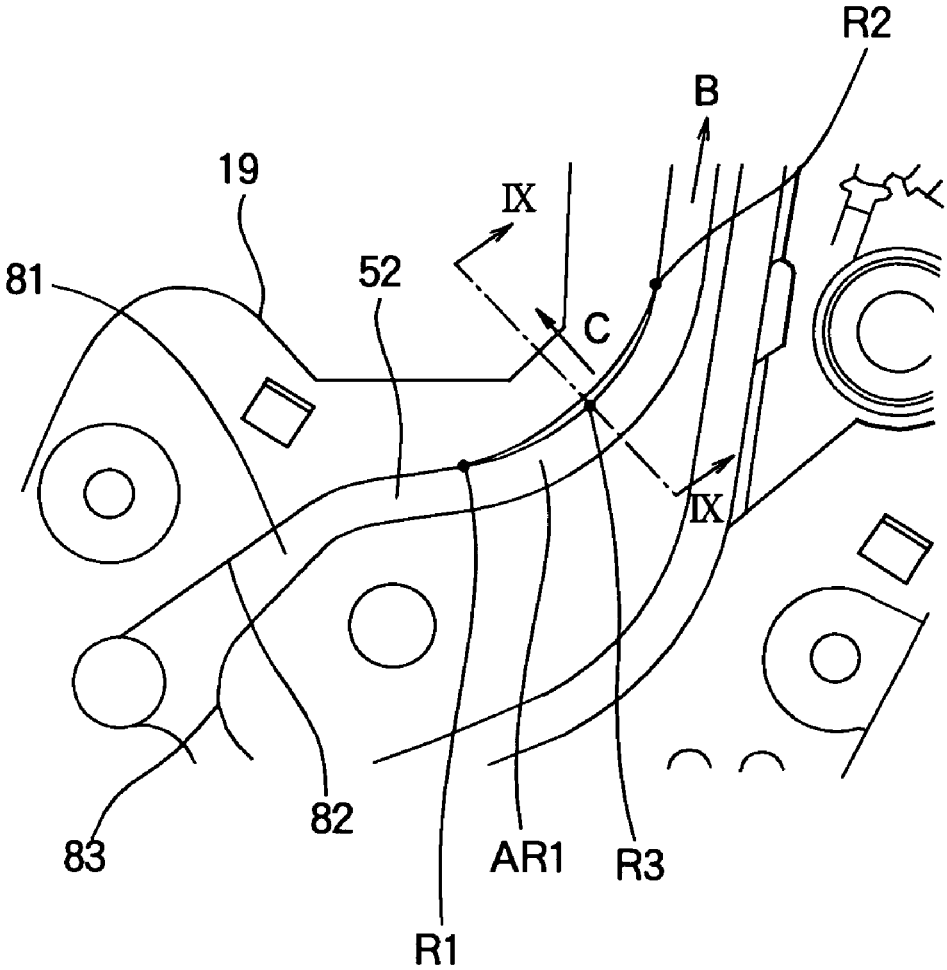
FIG. 8 is a side view showing a main part of the side frame according to the first embodiment of the present invention.
Figure 9:
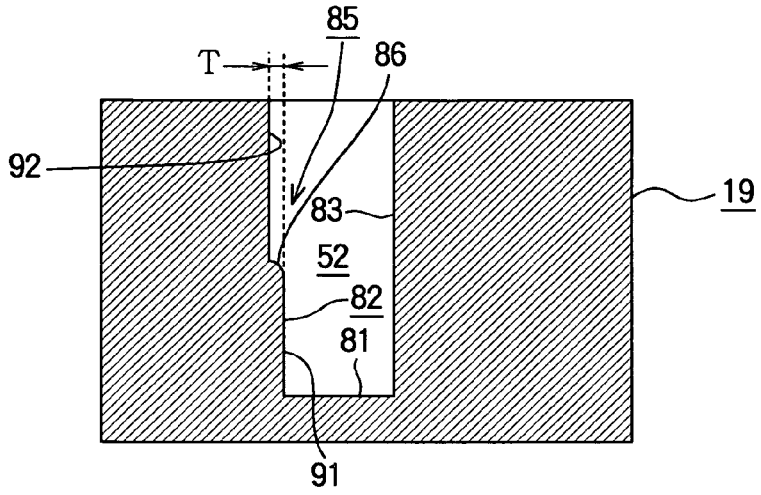
FIG. 9 is a sectional view taken along line IX-IX in FIG. 8.
Figure 10:
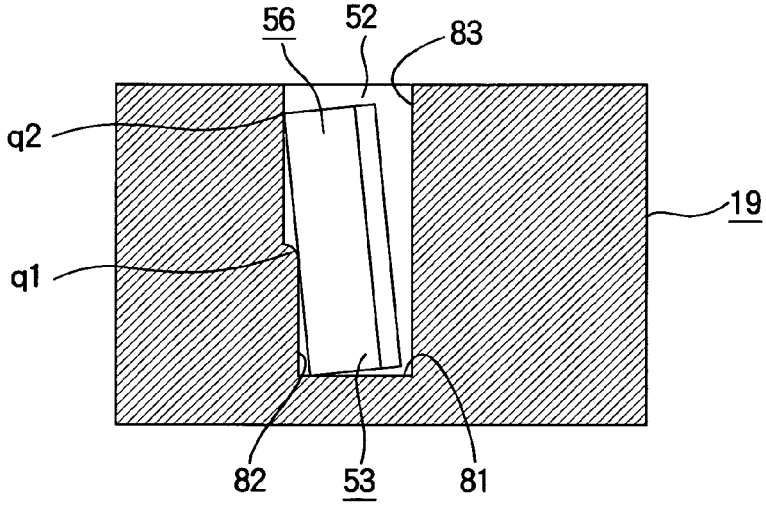
FIG. 10 is a sectional view showing a relationship between a groove and a toner conveying belt according to the first embodiment of the present invention.

FIG. 7 is a perspective view showing a main part of the side frame 19 according to the first embodiment of the present invention. FIG. 8 is an enlarged view of a part of the side frame 19 according to the first embodiment of the present invention. FIG. 9 is a sectional view taken along line IX-IX in FIG. 8. FIG. 10 is a sectional view showing a relationship between the groove 52 and the toner conveying belt 53 according to the first embodiment of the present invention.

As shown in FIG. 7, the groove 52 has a bottom wall 81, and further has a side wall 82 (i.e., an outer side wall) and a side wall 83 (i.e., an inner side wall) both of which are formed perpendicular to the bottom wall 81. The side walls 82 and 83 face each other.

The groove 52 has a curved section AR1 where the side wall 82 is curved so as to be convex toward the side wall 83. In this curved section AR1, the toner conveying belt 53 is applied with a tension when the toner conveying belt 53 moves in the direction B (FIG. 8). With such a tension, the toner conveying belt 53 tends to move toward the side wall 82 in a direction indicated by an arrow C in FIG. 8.

Therefore, in the first embodiment, a level-difference portion 85 (i.e., a contact portion) is formed on the side wall 82 in the curved section AR1, by varying a width of the groove 52 along a depth direction of the groove 52. To be more specific, as shown in FIG. 9, the width of the groove 52 at a part 92 farther from the bottom wall 81 is wider than the width of the groove 52 at a part 91 closer to the bottom wall 81. A difference between the width at the part 91 and the width at the part is expressed as a width difference T. The level-difference portion 85 extends along the curved section AR1.

As shown in FIG. 8, the width difference T is 0 mm at a starting point R1 of the curved section AR1 and at a terminal point R2 of the cured section AR1. The width different T increases as being apart from the starting point R1 or the terminal point R2, and shows its maximum, i.e., 0.5 mm, at a center point R3 between the starting point R1 and the terminal point R2. An edge portion 86 (FIG. 9) of the level-difference portion 85 is chamfered so as to have a curvature radius R. A chamfering amount is 0 mm at the starting point R1 of the curved section AR1 and at the terminal point R2 of the cured section AR1, and increases as approaching toward the center point R3 (i.e., as being apart from the starting point R1 or the terminal point R2), as with the level-difference amount.

As the toner conveying belt 53 moves, the toner conveying belt 53 tends to move toward the side wall 82. However, since the level-difference portion 85 is formed on the side wall 82 in the curved section AR1, the toner conveying belt 53 is inclined as shown in FIG. 10. In this state, the tip of the tooth 56 of the toner conveying belt 53 contacts the side wall 82 at two positions: a position q1 facing the level-difference portion 85 and a position q2 at an end of the tip of the tooth 56 (a distal end from the bottom wall 81). Therefore, a partial gap is formed between the side wall 82 and the tooth 56 of the toner conveying belt 53, with the result that a contact area between the tooth 56 and the side wall 82 is reduced.

With such a configuration, a friction between the toner conveying belt 53 and the side wall 82 of the groove 52 can be suppressed. As a result, it becomes possible to prevent the vibration of the toner conveying belt 53, and to prevent a noise caused by high frequency vibration.

Furthermore, since the friction between the toner conveying belt 53 and the side wall 82 can be suppressed, the melting of the waste toner can be prevented. Therefore, it becomes possible to prevent the increase in the load on the drum motor for driving the toner conveying belt 53. Consequently, a printing unevenness (due to an excessive load) on the drum motor can be prevented.

In the first embodiment, the level-difference portion 85 can be provided on other section of the groove 52 where a friction between the toner conveying belt 53 and the side wall of the groove 52 needs to be reduced.

First Modification.

Next, a description will be made of a first modification of the groove 52 according to the first embodiment of the present invention.

Figure 11:
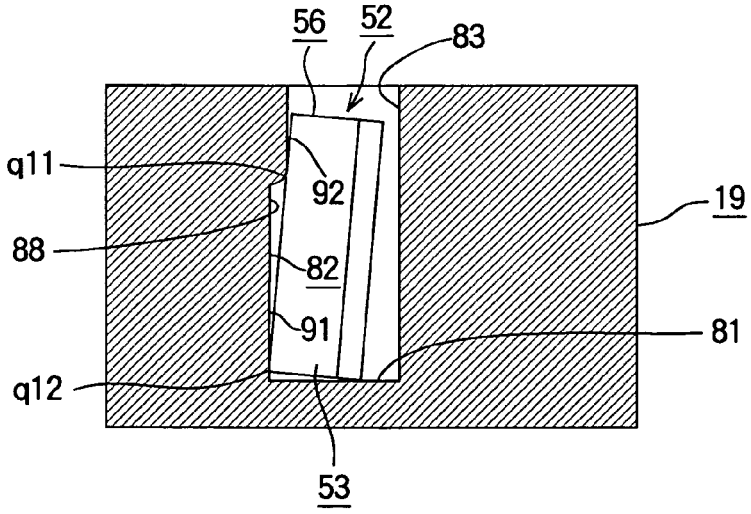
FIG. 11 is a sectional view showing a modification of the groove according to the first embodiment of the present invention.

FIG. 11 is a sectional view showing the first modification of the groove 52, together with the tooth 56 of the toner conveying belt 53.

In this modification, the groove 52 has a level-difference portion 88 in the curved section AR1. The level-difference portion 88 is formed in such a manner that the width of the groove 52 at a part 91 closer to the bottom wall 81 is wider than the width of the groove 52 at a part 92 farther from the bottom wall 81.

As the toner conveying belt 53 moves, the toner conveying belt 53 tends to move toward the side wall 82. However, since the level-difference portion 88 is formed on the side wall 82 in the curved section AR1, the toner conveying belt 53 is inclined as shown in FIG. 11. In this state, the tip of the tooth 56 contacts the side wall at two positions: a position q11 facing the level-difference portion 88 and a position q12 at an end of the tip of the tooth 56 (a proximal end from the bottom wall 81). In other words, a partial gap is formed between the side wall 82 and the tooth 56 of the toner conveying belt 53, with the result that a contact area between the tooth 56 and the side wall 82 is reduced.

Second Modification.

Next, a description will be made of a second modification of the groove 52 according to the first embodiment of the present invention.

Figure 12:
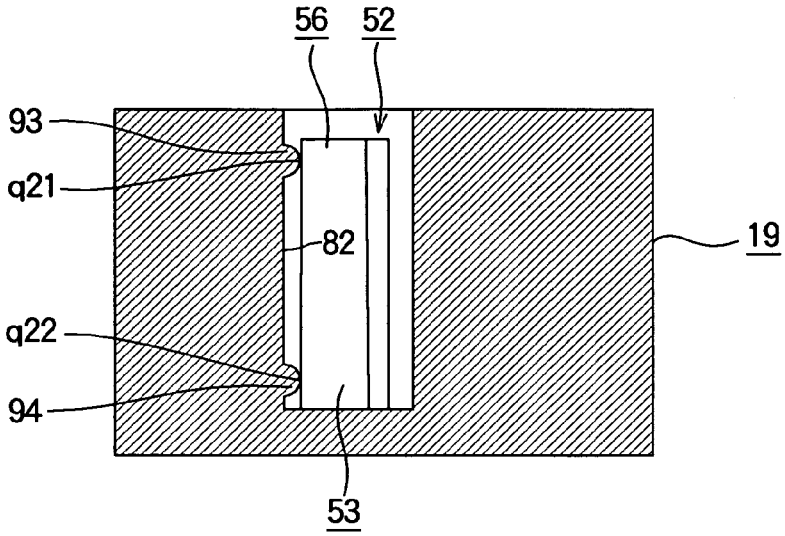
FIG. 12 is a sectional view showing another modification of the groove according to the first embodiment of the present invention.

FIG. 12 is a sectional view showing the second modification of the groove 52, together with the tooth 56 of the toner conveying belt 53.

In this modification, the groove 52 has protrusions and 94 (as a level-difference portion, or a contact portion) on the side wall 82 at two positions in the depth direction of the groove 52. The protrusion 93 is disposed farther from the bottom wall 81, and the protrusion 94 is disposed closer to the bottom wall 81. The width of the groove 52 where the protrusions 93 and 94 are not formed is wider than the width of the groove 52 where the protrusions 93 and 94 are formed.

The tip of the tooth 56 contacts the side wall 82 at two positions q21 and q22 facing the protrusions 93 and 94, and a partial gap is formed between the side wall 82 and the tooth 56 of the toner conveying belt 53. Therefore, a contact area between the tooth 56 and the side wall 82 is reduced.

Second Embodiment.

Next, the second'embodiment of the present invention will be described. Components of the second embodiment which are the same as those of the first embodiment are assigned the same reference numerals. Regarding the advantages obtained by the components which are the same as those of the first embodiment, explanations of the first embodiment are herein incorporated.

Figure 13:
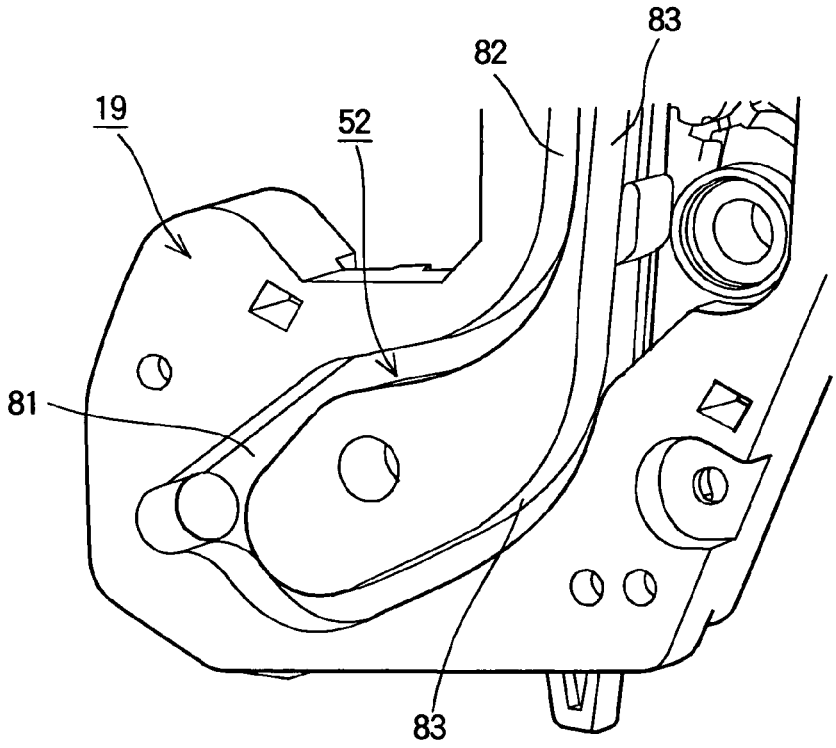
FIG. 13 is a perspective view showing a main part of a side frame according to the second embodiment of the present invention.
Figure 14:
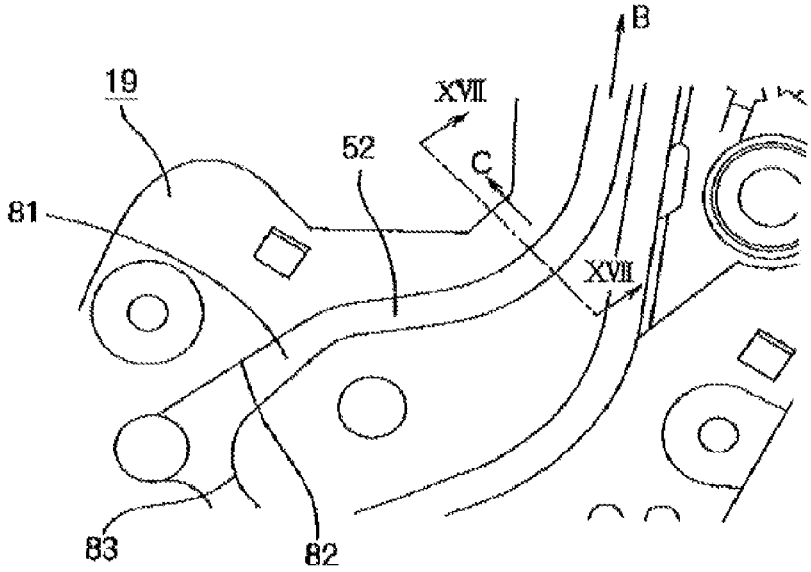
FIG. 14 is an enlarged view showing a main part of the side frame according to the second embodiment of the present invention.
Figure 15:
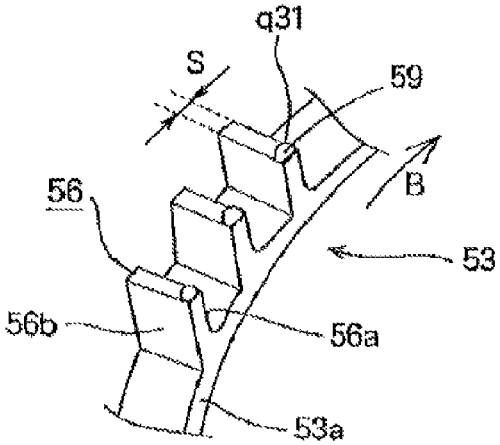
FIG. 15 is an enlarged view showing a part of a toner conveying belt according to the second embodiment.
Figure 16:
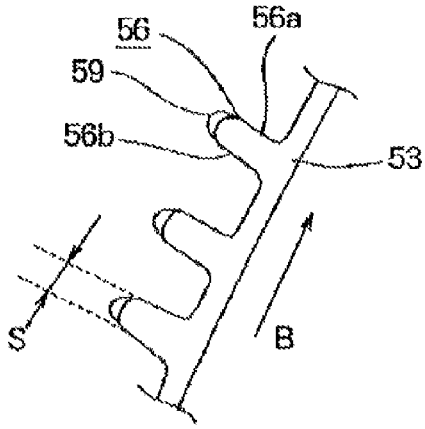
FIG. 16 is another enlarged view showing a part of the toner conveying belt according to the second embodiment.
Figure 17:
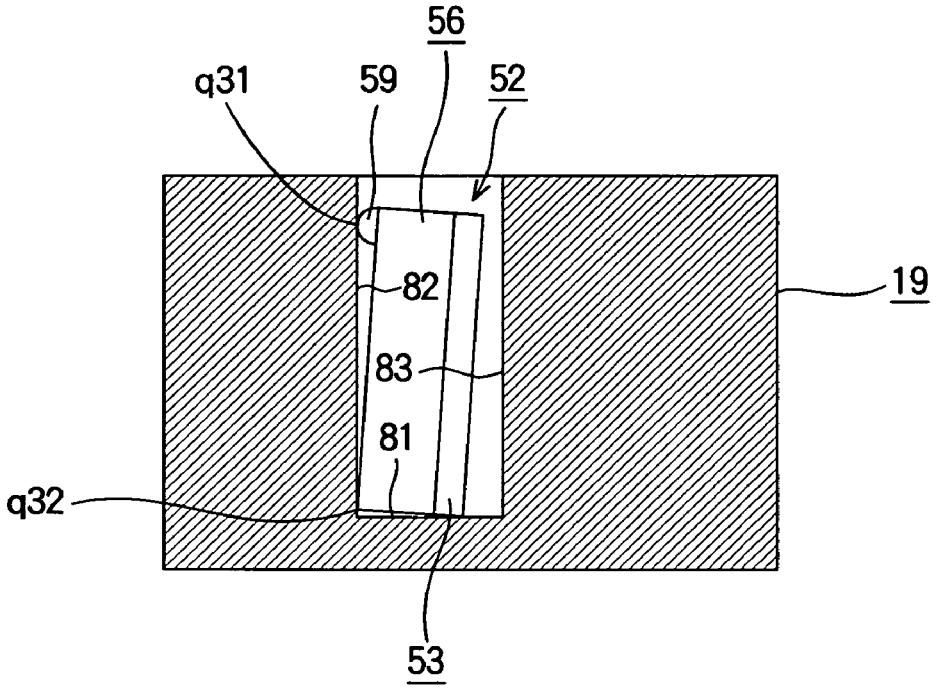
FIG. 17 is a sectional view taken along line XVII-XVII in FIG. 14.

FIG. 13 is a perspective view showing a main part of a side frame according to the second embodiment of the present invention. FIG. 14 is an enlarged view showing the main part of a side frame according to the second embodiment of the present invention. FIG. 15 is an enlarged view showing a part of a toner conveying belt according to the second embodiment of the present invention. FIG. 16 is another enlarged view showing a part of a toner conveying belt according to the second embodiment of the present invention. FIG. 17 is a sectional view taken along line XVII-XVII in FIG. 14.

As shown in FIGS. 13 and 14, the groove 52 of the second embodiment has no level-difference portion 85 (FIG. 7) described in the first embodiment.

Instead, as shown in FIGS. 15 and 16, each tooth 56 of the toner conveying belt 53 has a protrusion 59 (a contact portion, or a level-difference portion) at a tip thereof. The protrusion 59 is disposed at an end q31 of the tooth 56 in a widthwise direction of the toner conveying belt 53, i.e., a farthest end from the bottom wall 81 of the groove 52. The protrusion 59 has a hemispherical shape, and has a width which is the same as a tooth thickness S of the tooth 56. With such a protrusion 59, the height of the tooth 56 varies in the widthwise direction of the toner conveying belt 53.

The toner conveying belt (i.e., the developer conveying belt) 53 is moved by the rotation of the belt driving gear 65 (i.e., the belt driving element) as described in the first embodiment. In this regard, the protrusion 59 is formed on the end portion of the tooth 56 in the widthwise direction of the toner conveying belt 53 (more specifically, the farthest end from the bottom wall 81), which is different from a position where the tooth 56 meshes with the belt driving gear 65. Therefore, the protrusion 59 does not interfere with the meshing between the tooth 56 and the belt driving gear 65.

As the toner conveying belt 53 moves in the direction shown by the arrow B in FIG. 14, a tension is applied to the toner conveying belt 53. With such a tension, the toner conveying belt 53 tends to move in the direction indicated by the arrow C toward the side wall 82. However, since the tooth 56 has the protrusion 59, the tooth 56 is inclined as shown in FIG. 17. In this state, the tip of the tooth 56 contacts the side wall 82 at two positions: an end q31 farthest from the bottom wall 81 and an end q32 closest to the bottom wall 81, so that a partial gap is formed between the side wall 82 and the toner conveying belt 53. With such a configuration, a contact area between the side wall 82 and the toner conveying belt 53 can be reduced.

Further, since it is not necessary to form a level-difference portion 85 (FIG. 7) in the groove 52, a manufacturing cost of the side frame 19 can be reduced.

Modification.

Figure 18:
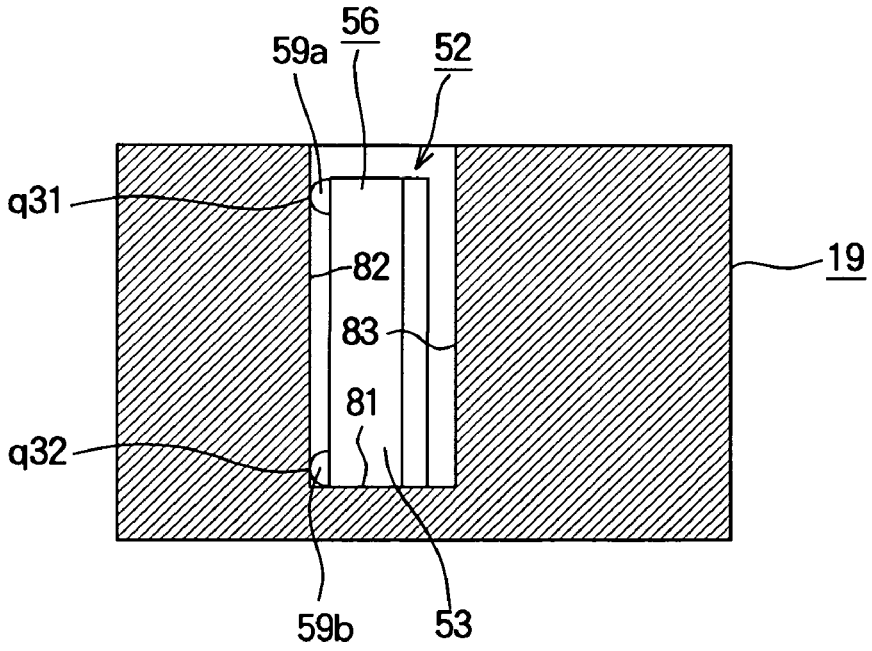
FIG. 18 is a sectional view showing a modification of the toner conveying belt according to the second embodiment of the present invention.

FIG. 18 is a sectional view showing a modification of the toner conveying belt 53 according to the second embodiment of the present invention.

In the modification shown in FIG. 18, each tooth 56 of the toner conveying belt 53 has two protrusions 59*a* and 59*b* (contact portions, or level-difference portions) at a tip thereof. The protrusions 59*a* and 59*b* are disposed at both ends of the tooth in a widthwise direction of the toner conveying belt 53. To be more specific, the protrusion 59*a* is disposed at an end q31 of the tooth 56 farthest from the bottom wall 81. The protrusion 59*b* is disposed at an end q32 of the tooth 56 closest to the bottom wall 81. Each of the protrusions 59*a* and 59*b* has a hemispherical shape, and has a width which is the same as a tooth thickness S of the tooth 56.

As the toner conveying belt 53 moves, a tension is applied to the toner conveying belt 53, and the toner conveying belt 53 tends to move toward the side wall 82. However, since the tooth 56 has the protrusions 59*a* and 59*b*, the tip of the tooth 56 contacts the side wall 82 at two positions: an end q31 farthest from the bottom wall 81 and an end q32 closest to the bottom wall 81. That is, a partial gap is formed between the side wall 82 and the tip of the tooth 56 of the toner conveying belt 53, and therefore a contact area between the side wall 82 and tooth 56 of the toner conveying belt 53 is reduced.

With such a configuration, a friction between the toner conveying belt 53 and the side wall 82 of the groove 52 can be suppressed. As a result, it becomes possible to prevent the vibration of the toner conveying belt 53, and to prevent a noise caused by high frequency vibration.

In the above described embodiments and modifications, the color printer has been described as an example of the image forming apparatus. However, the present invention is applicable to a copier, a printer, a facsimile machine or the like.

While the preferred embodiments of the present invention have been illustrated in detail, it should be apparent that modifications and improvements may be made to the invention without departing from the spirit and scope of the invention as described in the following claims.

What is claimed is:

1. An image forming unit comprising:

a developer collecting portion for collecting a developer;

a developer conveying portion having a receiving portion and an exit portion; and a conveying belt that conveys said developer from said receiving portion to said exit portion;

wherein said developer conveying portion has a guide portion for guiding said conveying belt;

wherein one of said guide portion and said conveying belt has a contact portion that causes said guide portion and said conveying belt to partially contact each other in such a manner that a gap is partially formed therebetween; and wherein said gap between said guide portion and said conveying belt varies at least partially along a widthwise direction of said conveying belt.

2. The image forming unit according to claim 1, further comprising a rotatable image bearing body having a surface on which a developer image is formed;

wherein said developer collecting portion is a cleaning member that removes said developer from said surface of said image bearing body after a transferring of said developer image;

wherein said developer conveying portion is positioned lateral to said image bearing body; and wherein a conveying unit is provided along said image bearing body, which conveys said developer having been removed by said cleaning member to said receiving portion of said developer conveying portion.

3. The image forming unit according to claim 1, wherein said guide portion is a groove.

4. The image forming unit according to claim 3, wherein said contact portion is a level-difference portion formed on a side wall of said groove.

5. The image forming unit according to claim 4, wherein said level-difference portion is disposed on a curved section of said groove.

6. The image forming unit according to claim 3, wherein said contact portion is a protrusion formed on a side wall of said groove.

7. The image forming unit according to claim 6, wherein said protrusion is disposed on a curved section of said groove.

8. The image forming unit according to claim 3, wherein said conveying belt has teeth protruding from an outer circumferential surface thereof, and said teeth of said conveying belt contact a side wall of said groove.

9. The image forming unit according to claim 8, wherein said contact portion is a protrusion formed on each of said teeth of said conveying belt.

10. The image forming unit according to claim 1, wherein:

said contact portion includes a first part that causes said gap to gradually increase along a moving direction of said conveying belt, and a second part that causes said gap to gradually decrease along said moving direction of said conveying belt; and said first part and said second part are continuously formed.

11. An image forming unit comprising:

a developer collecting portion for collecting a developer;

a developer conveying portion having a receiving portion and an exit portion; and a conveying belt that conveys said developer from said receiving portion to said exit portion;

wherein said developer conveying portion has a guide portion for guiding said conveying belt;

wherein said guide portion has a contact portion that causes said guide portion and said conveying belt to partially contact each other in such a manner that a gap is partially formed therebetween; and wherein said gap between said guide portion and said conveying belt varies at least partially along a widthwise direction of said conveying belt.

12. The image forming unit according to claim 11, further comprising a rotatable image bearing body having a surface on which a developer image is formed;

wherein said developer collecting portion is a cleaning member that removes said developer from said surface of said image bearing body after a transferring of said developer image;

wherein said developer conveying portion is positioned lateral to said image bearing body; and wherein a conveying unit is provided along said image bearing body, which conveys said developer having been removed by said cleaning member to said receiving portion of said developer conveying portion.

13. The image forming unit according to claim 11, wherein said guide portion is a groove.

14. The image forming unit according to claim 13, wherein said contact portion is a level-difference portion formed on a side wall of said groove.

15. The image forming unit according to claim 14, wherein said level-difference portion is disposed on a curved section of said groove.

16. The image forming unit according to claim 14, wherein said level-difference portion has an edge portion which is chamfered.

17. The image forming unit according to claim 13, wherein said contact portion is a protrusion formed on a side wall of said groove.

18. The image forming unit according to claim 17, wherein said protrusion is disposed on a curved section of said groove.

19. The image forming unit according to claim 13, wherein said conveying belt has teeth protruding from an outer circumferential surface thereof, and said teeth of said conveying belt contact a side wall of said groove.

20. The image forming unit according to claim 11, wherein:

said contact portion includes a first part that causes said gap to gradually increase along a moving direction of said conveying belt, and a second part that causes said gap to gradually decrease along said moving direction of said conveying belt; and said first part and said second part are continuously formed.

21. An image forming unit comprising:

a developer collecting portion for collecting a developer;

a developer conveying portion having a receiving portion and an exit portion; and a conveying belt that conveys said developer from said receiving portion to said exit portion;

wherein said developer conveying portion has a guide portion for guiding said conveying belt;

wherein said conveying belt has a contact portion that causes said guide portion and said conveying belt to partially contact each other in such a manner that a gap is partially formed therebetween; and wherein said gap between said guide portion and said conveying belt varies at least partially along a widthwise direction of said conveying belt.

22. The image forming unit according to claim 21, further comprising a rotatable image bearing body having a surface on which a developer image is formed;

wherein said developer collecting portion is a cleaning member that removes said developer from said surface of said image bearing body after a transferring of said developer image;

wherein said developer conveying portion is positioned lateral to said image bearing body; and wherein a conveying unit is provided along said image bearing body, which conveys said developer having been removed by said cleaning member to said receiving portion of said developer conveying portion.

23. The image forming unit according to claim 21, wherein said guide portion is a groove.

24. The image forming unit according to claim 23, wherein said conveying belt has teeth protruding from an outer circumferential surface thereof, and said teeth of said conveying belt contact a side wall of said groove.

25. The image forming unit according to claim 24, wherein said contact portion is a protrusion formed on each of said teeth of said conveying belt.

26. The image forming unit according to claim 21, wherein:

said contact portion includes a first part that causes said gap to gradually increase along a moving direction of said conveying belt, and a second part that causes said gap to gradually decrease along said moving direction of said conveying belt; and said first part and said second part are continuously formed.

27. An image forming apparatus comprising:

a developer collecting portion for collecting a developer;

a developer conveying portion having a receiving portion and an exit portion; and a conveying belt that conveys said developer from said receiving portion to said exit portion;

wherein said developer conveying portion has a guide portion for guiding said conveying belt;

wherein one of said guide portion and said conveying belt has a contact portion that causes said guide portion and said conveying belt to partially contact each other in such a manner that a gap is partially formed therebetween; and wherein said gap between said guide portion and said conveying belt varies at least partially along a widthwise direction of said conveying belt.

28. The image forming apparatus according to claim 27, further comprising a rotatable image bearing body having a surface on which a developer image is formed;

wherein said developer collecting portion is a cleaning member that removes said developer from said surface of said image bearing body after a transferring of said developer image;

wherein said developer conveying portion is positioned lateral to said image bearing body; and wherein a conveying unit is provided along said image bearing body, which conveys said developer having been removed by said cleaning member to said receiving portion of said developer conveying portion.

29. The image forming apparatus according to claim 27, wherein said guide portion is a groove.

30. The image forming apparatus according to claim 27, wherein:

said contact portion includes a first part that causes said gap to gradually increase along a moving direction of said conveying belt, and a second part that causes said gap to gradually decrease along said moving direction of said conveying belt; and said first part and said second part are continuously formed.

* * * * *